US008317487B2

(12) United States Patent
Suzuki et al.

(10) Patent No.: US 8,317,487 B2
(45) Date of Patent: Nov. 27, 2012

(54) RECIPROCATING-TYPE COMPRESSOR

(75) Inventors: Ryoma Suzuki, Saitama (JP); Ryosuke Izawa, Saitama (JP)

(73) Assignee: Valeo Japan Co., Ltd., Saitama (JP)

( * ) Notice: Subject to any disclaimer, the term of this patent is extended or adjusted under 35 U.S.C. 154(b) by 0 days.

(21) Appl. No.: 13/435,135

(22) Filed: Mar. 30, 2012

(65) Prior Publication Data

US 2012/0251345 A1 Oct. 4, 2012

(51) Int. Cl.

| | |
|---|---|
| ***F04B 1/26*** | (2006.01) |
| ***F04B 39/10*** | (2006.01) |
| ***F04B 53/10*** | (2006.01) |
| ***F01B 31/00*** | (2006.01) |

(52) U.S. Cl. ..... 417/222.1; 417/534; 92/163

(58) Field of Classification Search ..... 92/71, 163, 92/164, 169.1; 417/222.1, 222.2, 534
See application file for complete search history.

(56) References Cited

U.S. PATENT DOCUMENTS

2004/0161346 A1 * 8/2004 Hwang et al. ..... 417/312
2009/0136364 A1 * 5/2009 Lim et al. ..... 417/269

FOREIGN PATENT DOCUMENTS

JP 3153200 U 8/2009

OTHER PUBLICATIONS

Machine Translation for JP3153200 U extracted from JPO, Mar. 9, 2012, 20 pages.

* cited by examiner

*Primary Examiner* — Devon Kramer
*Assistant Examiner* — Bryan Lettman
(74) *Attorney, Agent, or Firm* — Howard & Howard Attorneys PLLC

(57) ABSTRACT

The respective spaces for forming gas passages on the suction side formed on the front and rear side cylinder blocks are assembled together to configure a gas passage on the suction side, and the respective spaces for providing gas passages on the discharge side are connected with each other to configure a gas passage on the discharge side. A gas port leading to the suction side space is provided on one of both cylinder blocks, and a gas port leading to the discharge side space is arranged on the other. A circumferential width of the space for forming a gas passage communicating with the gas port is made larger than a circumferential width of a space for forming a gas passage not communicating with the gas port in the respective cylinder block. Partition walls are contacted with each other in the axial direction when both cylinder blocks are assembled.

16 Claims, 7 Drawing Sheets

A–A (a)

B-B (b)

C-C

D-D (a)

(b)

PRIOR ART

PRIOR ART

RECIPROCATING-TYPE COMPRESSOR

RELATED APPLICATIONS

This application claims priority to and all the advantages of Japanese Patent Application No. JP 2011-001731, filed on Mar. 30, 2011.

BACKGROUND OF THE INVENTION

1. Field of the Invention

The present invention relates to a compressor used for an air-conditioning system for vehicles, and specifically relates to a reciprocating type compressor used for an air-conditioning system for large-sized vehicles such as buses.

2. Description of the Related Art

As shown in FIG. 1, a compressor of this type comprises a front side cylinder block 2 in which front side cylinder bores 20 are formed, a rear side cylinder block 3 in which a rear side cylinder bores 30 are formed, a front head 5 assembled on the front side (on the left side in FIG. 1) of the front side cylinder block 2 with a valve plate 4 interposed therebetween, and a rear head 7 assembled on the rear side (on the right side in FIG. 1) of the rear side cylinder block 3 with a valve plate 6 interposed therebetween (see Utility Model Registration No. 3153200).

The front head 5, the valve plate 4, the front side cylinder block 2, the rear side cylinder block 3, the valve plate 6 and the rear head 7 are fastened in the axial direction by fastening bolts 8 to configure a housing of the compressor.

A plurality of the front side cylinder bores 20 formed on the front side cylinder block 2 and a plurality of the rear side cylinder bores 30 formed on the rear side cylinder block 3 are disposed at regular interval along respective virtual circumferences whose center is a shaft 16, and the cylinder bore 20 and the cylinder bore 30 which face each other are constructed in a manner that respective center lines are put together, so that the front side cylinder block 2 and the rear side cylinder block 3 define a crank chamber 10 therebetween. The cylinder blocks (the front side cylinder block 2 and the rear side cylinder block 3) further support the shaft which goes through the crank chamber 10.

Further, a swash plate 43 which is securely attached to the shaft 16 is provided in the crank chamber, and the shaft 16 is rotated and the swash plate 43 is rotated thereby so as to reciprocate each double-headed piston 40 sliding in the cylinder bore of the front side cylinder block 2 and the cylinder bore of the rear side cylinder block 3 which face each other. As a result, in each of the cylinder bores 20, 30, between the double-headed piston 40 inserted therein and the valve plates 4, 6, compression chamber 41, 42 whose capacity changes in accordance with movement of the double-headed piston 40 is defined.

On the respective valve plates 4, 6, suction holes 4*a*, 6*a* which are opened and closed by respective suction valves and discharge holes 4*b*, 6*b* which are opened and closed by respective discharge valves are formed, correspondingly to the respective cylinder bores 20, 30. On the front head 5 and the rear head 7, suction chambers 5*a*, 7*a* for containing refrigerant to be supplied to the compression chambers 41, 42 and discharge chambers 5*b*,7*b* for containing refrigerant discharged from the compression chambers 41, 42 are formed, respectively. The suction chambers 5*a*, 7*a* are formed approximately on the center of the front head 5 and the rear head 7, respectively, and the discharge chambers 5*b*, 7*b* are formed around the suction chambers 5*a*, 7*a*.

Further in this example, the front side cylinder block 2 and the rear side cylinder block 3 have a pair of gas passages (a gas passage on the suction side 51, a gas passage on the discharge side 52) in the suction side and the outlet side that are formed along the axial direction of the shaft 16, which are deviated each other in the circumferential direction in a manner that run through both of the front side cylinder block 2 and the rear side cylinder block 3 as shown in FIGS. 7 and 8. The gas passage on the suction side 51 and the gas passage on the discharge side 52 are formed symmetrical to a plane containing an axis of the shaft 16 and located in the center of the both gas passages, and a gas port on the suction side 53 leading to the gas passage on the suction side 51 is provided on one of the front side cylinder block 2 and the rear side cylinder block 3 and a gas port on the discharge side 54 leading to the gas passage on the discharge side 52 is provided on the other thereof. The gas port on the suction side 53 is guided to the suction chambers 5*a*, 7*a* formed on the front head 5 and the rear head 7 through the gas passage on the suction side 51, and the gas port on the discharge side 54 is guided to the discharge chambers 5*b*, 7*b* formed on the front head 5 and the rear head 7 through the gas passage on the discharge side 52.

In refrigerant exchange work particularly for an air-conditioning system of large-sized vehicles such as buses, in which refrigerant of about 10 kg is enclosed in a reciprocating-type compressor like above, the exchange work requires disassembling a piping to discharge enclosed refrigerant and assemble the piping again to fill new refrigerant, thus requiring labor-intensive work and increased maintenance costs incurred for the work. To avoid such problems, pipes are connected to the gas port on the suction side 53 and the gas port on the discharge side 54 through a pipe connectors 60 which each has a shut off valve as shown in FIG. 7, and when the pipes are removed, the shut off valves are closed so as to prevent the outflow of the refrigerant between the compressor and refrigerating cycle system.

However, each pipe connector 60 is usually placed approximately perpendicular to an axial line of the compressor so that it protrudes toward the tangential direction from the peripheral wall of the compressor for the convenience of the pipe layout (because the pipe is connected at the side of the compressor). As shown in FIG. 8, if the gas port on the suction side 53 and the gas port on the discharge side 54 are formed right above the gas passage on the suction side 51 and the gas passage on the discharge side 52 respectively, one pipe connector 60 may be attached within space where a compressor is allowed to be mounted above the compressor, but the other pipe connector 60 excessively protrudes in the lateral direction of the compressor and interferes with adjacent objects (an engine or other auxiliary machines) which inconveniently makes impossible to place the compressor in the limited mounting space.

For this reason, in order to restrict the protrusion length of the pipe connector 60 in the lateral direction (protrusion amount in the tangential direction of the cylinder block), the gas port on the suction side and the gas port on the discharge side provided above the housing should be preferably arranged in parallel above an axis of the compressor (at approximately the midsection of the horizontal width perpendicular to an axis) along the axial line when viewed from above the housing as shown in FIG. 9.

However, since the gas passage on the suction side and the gas passage on the discharge side are extending along the axial direction in the cylinder block, and provided in parallel so as to be deviated each other in the circumferential direction, therefore if attempting to provide the gas port on the suction side and the gas port on the discharge direction in parallel along the axial line, it is impossible to realize such a configuration because each gas port cannot be placed right above the corresponding gas passage.

Further in the compressor of this type, front and back vibration due to compression reaction force is large and the reaction force is then transmitted to the cylinder block through the swash plate and the energy is radiated to the outside as a vibration of the compressor. For this reason, the compressor is designed so as to absorb the vibration by rigidity of the cylinder block and a thrust bearing which is interposed between the swash plate and the cylinder block and receives a thrust load of the swash plate. If, however, a shape of the cylinder block on the front side and that on the rear side are different, the rigidity is not equal, which easily results in a partial wear of a portion which receives the thrust load.

The present invention has been made with a view to such circumstances and mainly aims to provide a compressor enabling to make protrusion of the pipe connector in the lateral direction of the compressor smaller, which is to be provided to the cylinder block, and also aims at providing a reciprocating-type compressor, enabling to reduce the partial wear of a sliding contact portion which receives the thrust load of compressor inside structure.

BRIEF SUMMARY OF THE INVENTION

In order to solve the above-described problem, a reciprocating-type compressor according to the present invention comprises;

a front side cylinder block on which front side cylinder bores are formed, a rear side cylinder block on which rear side cylinder bores are formed, a crank chamber which is formed between the front side cylinder block and the rear side cylinder block by assembling them, a shaft which goes through the crank chamber and is rotatably supported in the front side cylinder block and the rear side cylinder block, a swash plate which is provided in the crank chamber and is rotated by the shaft, double-headed pistons which each is inserted in the respective cylinder bores of the front side cylinder block and the rear side cylinder block which face each other and is reciprocated by rotation of the swash plate, a space for forming a gas passage on the suction side and a space for forming a gas passage on the discharge side extending along the axial direction of the shaft and being provided in parallel outside the pitch circle of the cylinder bore in the front side cylinder block and the rear side cylinder block respectively, a gas passage on the suction side formed by connecting the space for forming a gas passage on the suction side formed in the front side cylinder block and the space for forming a gas passage on the suction side formed in the rear side cylinder block, a gas passage on the discharge side formed by connecting the space for forming a gas passage on the discharge side formed in the front side cylinder block and the space for forming a gas passage on the discharge side formed in the rear side cylinder block, a gas port on the suction side leading to the space for forming a gas passage on the suction side and being provided in one of the front side cylinder block and the rear side cylinder block, a gas port on the discharge side leading to the space for forming a gas passage on the discharge side and being provided in the other of the front side cylinder block and the rear side cylinder block, and a partition wall which partitions the space for forming a gas passage on the suction side and the space for forming a gas passage on the discharge side and is placed such that a circumferential width of the space for forming a gas passage communicated with the gas port is larger than a circumferential width of the space for forming a gas passage not communicated with the gas port in each of the front side cylinder block and the rear side cylinder block, wherein the respective partition walls are contacted with each other in the axial direction when the front side cylinder block and the rear side cylinder block are assembled.

In connection with the gas passage on the suction side and the gas passage on the discharge side, a circumferential width of the space for forming a gas passage communicated with the gas port (the gas port on the suction side and the gas port on the discharge side) is formed larger than a circumferential width of a space for forming a gas passage which is not communicated with the gas port in each of the front side cylinder block and the rear side cylinder block, and the respective partition walls which partition the space for forming a gas passage communicating with the gas port and the space for forming a gas passage not communicating with the gas port are contacted with each other in the axial direction when the front side cylinder block and the rear side cylinder block are assembled. Accordingly, in the respective cylinder blocks, the gas port (the gas port on the suction side and the gas port on the discharge side) can be arranged closer to the gas passage which is not communicated with the gas port, so that the gas port on the suction side and the gas port on the discharge side can be arranged closer to the center as much as possible. For this reason, even if a pipe connector having the shut-off valve is provided on each of the gas ports approximately vertically to an axis of the compressor, and extended in the tangential direction of a periphery of the cylinder block, thus the protruding amount of the pipe connector in the lateral direction of the compressor can be reduced significantly.

An oil introduction port leading to the crank chamber is preferably provided at the partition wall in at least one of the front side cylinder block and the rear side cylinder block.

As described above, a circumferential width of the space for forming a gas passage communicated with the gas port is made larger than a circumferential width of a space for forming a gas passage not communicated with the gas port, and the respective partition walls of the front side cylinder block and the rear side cylinder block are contacted with each other in the axial direction when the front side cylinder block and the rear side cylinder block are assembled. As a result, a width of the partition wall is thick enough to have the oil introduction port, and making use of this wide partition wall it possible to pierce the oil introduction port without interfering with the space for forming a gas passage and the gas port.

This means that the space for a gas passage on the suction side forming the gas passage on the suction side and the space for a gas passage on the discharge side forming the gas passage on the discharge side which are formed in the respective front side cylinder block and the rear side cylinder block, and the suction side gas port and the discharge side gas port are neither arranged symmetrical to a plane on which the front side cylinder block and the rear side cylinder block are connected, and also they are nor arranged symmetrical to a vertical plane containing an axis of the shaft. On the hand, the front side cylinder bore, the rear side cylinder bore and the crank chamber are preferably arranged symmetrical respectively to the connected plane between the front side cylinder block and the rear side cylinder block, and also symmetrical respectively to the vertical plane containing an axis of the shaft.

Such configuration may reduce ununiformity of rigidity of the front side cylinder block and the rear side cylinder block, and the compression reaction force can be evenly transmitted to respective cylinder blocks through the swash plate.

Further when forming conjoint mounting legs for fixing the front side cylinder block and the rear side cylinder block at the mounting portions, the mounting legs are preferably arranged symmetrical to the connected plane between the front side cylinder block and the rear side cylinder block in order to reduce ununiformity of the rigidity of each cylinder block and further preferably be formed symmetrical to the vertical plane containing an axis of the shaft.

As described above, according to the present invention, in connection with the gas passage on the suction side and the gas passage on the discharge side formed in the cylinder blocks, a circumferential width of the space for forming a gas passage which is communicated with the gas port (gas port on the suction side, gas port on the discharge side) is made larger than a circumferential width of a space for forming a gas passage which is not communicated with the gas port in each of the front side cylinder block and the rear side cylinder block, and because the respective partition walls which partition the space for forming a gas passage communicated with the gas port and the space for forming a gas passage not communicated with the gas port are contacted with each other in the axial direction at a time of assembling the front side cylinder block and the rear side cylinder block, the gas port on the suction side and the gas port on the discharge side can be placed closer to the center as much as possible, decreasing pipe connector protrusion amount in the lateral direction. Accordingly, the compressor can avoid interference to an engine and auxiliary machines adjacent to the compressor, thus it makes possible to mount the compressor in the limited space.

Further, although the space for forming a gas passage in the front side cylinder block and the space for forming a gas passage in the rear side cylinder block are asymmetrical to the connected plane between the both cylinder blocks, the respective spaces for forming gas passages which are communicated with the gas ports can have the same shape, and also the respective spaces for forming gas passages which are not communicated with the gas ports can have the same shape. Therefore, the front side cylinder block and the rear side cylinder block can be manufactured using the same molding die.

Further, by arranging the front side cylinder bores formed in the front side cylinder block, the rear side cylinder bores formed in the rear side cylinder block and the crank chamber symmetrical to a connected plane between the front side cylinder block and the rear side cylinder block, and also arranging them symmetrical to a vertical plane containing an axis of the shaft, ununiformity of the rigidity of the front side cylinder block and the rear side cylinder block is greatly reduced to eliminate the partial wear of a sliding portion. Ununiformity and partial wear are also reduced by arranging the mounting legs provided on the respective cylinder blocks symmetrical to a connected plane between the front side cylinder block and the rear side cylinder block, and also symmetrical to a vertical plane containing an axis of the shaft.

DETAILED DESCRIPTION OF THE INVENTION

An embodiment of the present invention will be hereinafter described with reference to the accompanying drawings.

Figure 1:
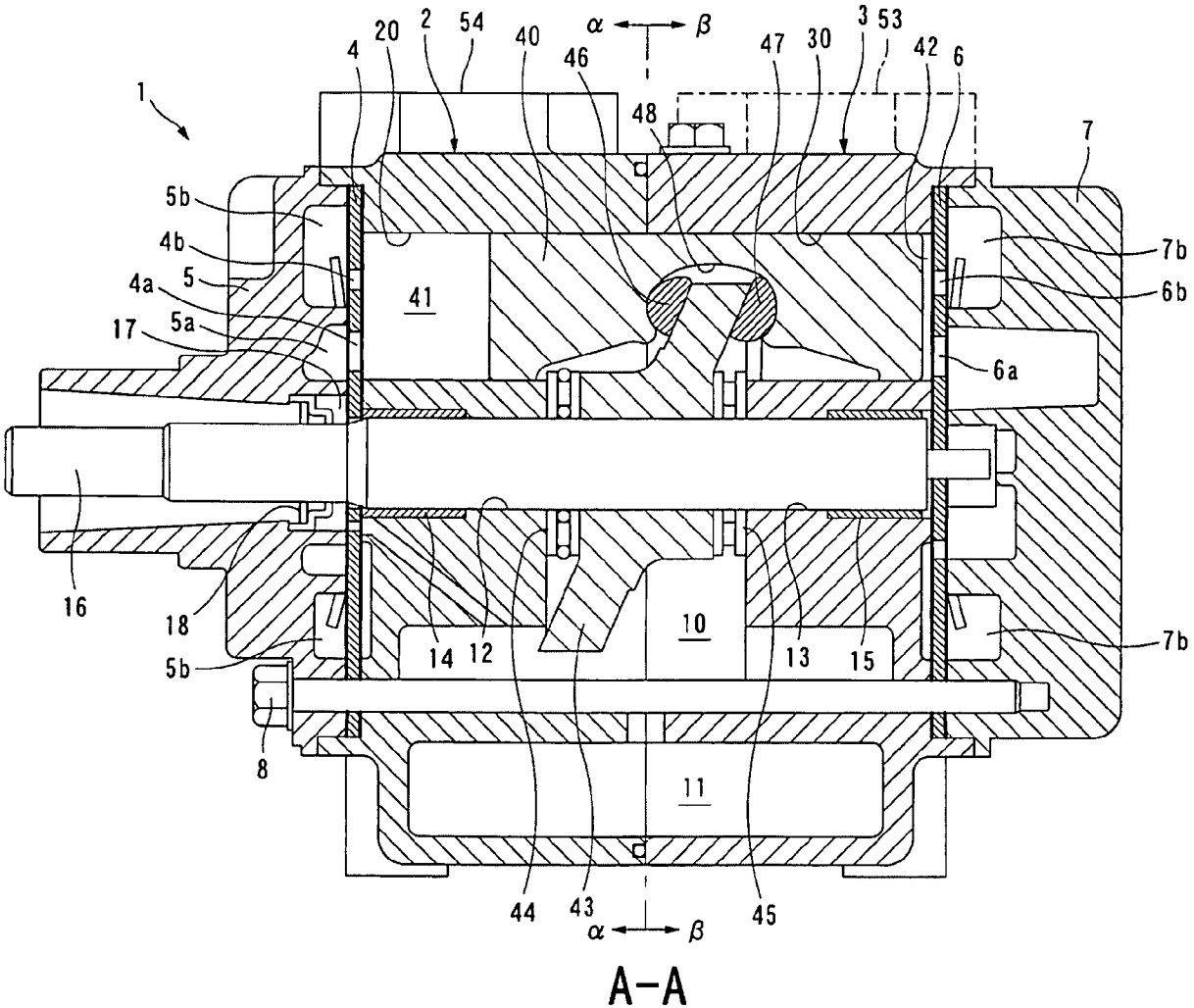
FIG. 1 is a sectional view along A-A line in FIG. 2(*b*) showing an overall structure of a reciprocating-type compressor according to the present invention.
Figure 2:
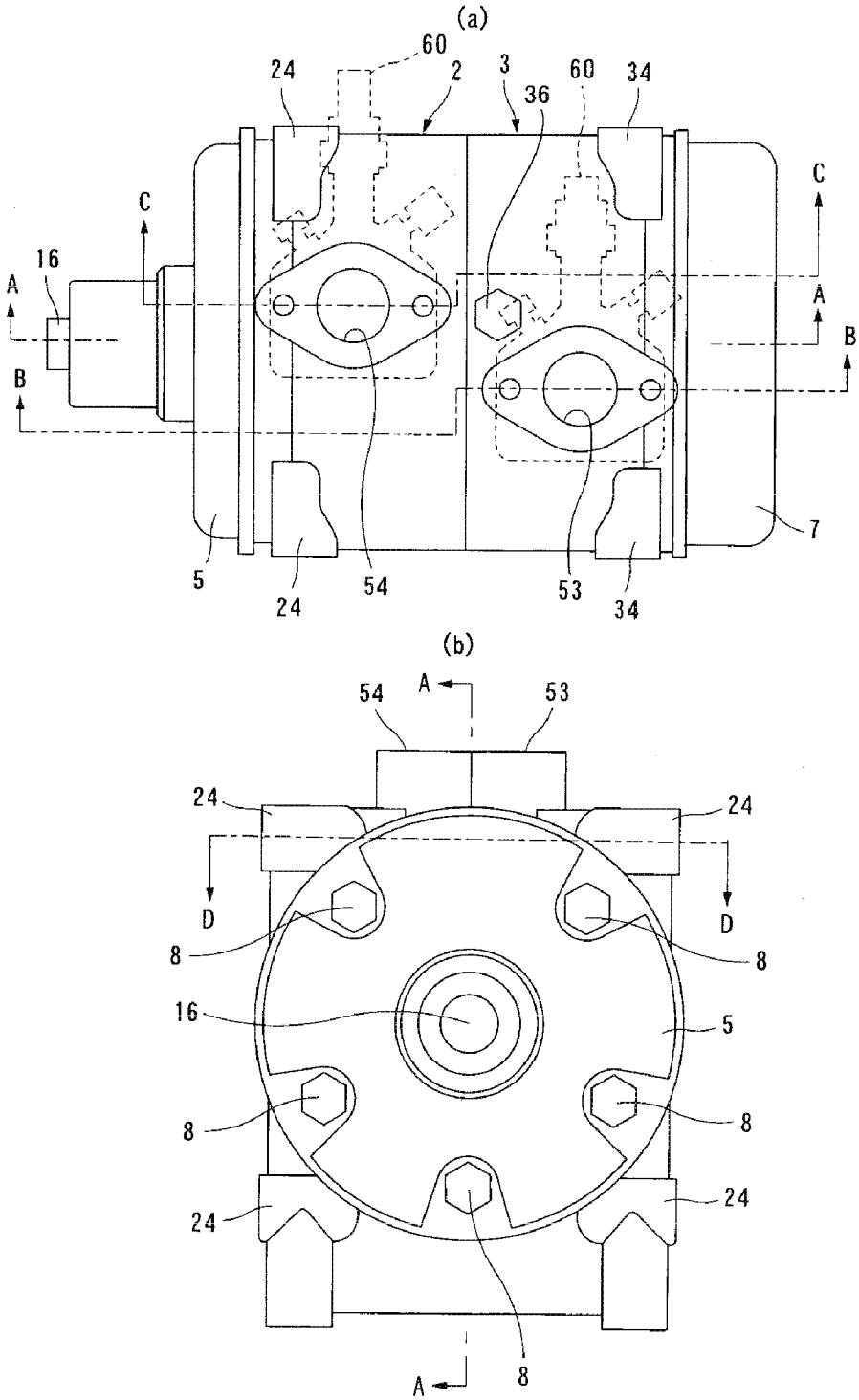
FIG. 2 is a schematic view showing a reciprocating compressor in FIG. 1, (a) is a view seen from the above, and (b) is a view seen from the front side.

As one example of an embodiment of the present invention, a reciprocating type compressor 1 used for refrigerating cycle using refrigerant as a working fluid in an air-conditioning system for large-sized vehicles such as buses is shown in FIG. 1 and FIG. 2.

The present reciprocating type compressor 1 comprises a front side cylinder block 2, a rear side cylinder block 3 assembled on the front side cylinder block 2, a front head 5 assembled on the front side (on the left side in FIG. 1) of the front side cylinder block with a valve plate 4 interposed therebetween, a rear head 7 assembled on the rear side (on the right side in FIG. 1) of the rear side cylinder block 3 with a valve plate 6 interposed therebetween. The front head 5, the valve plate 4, the front side cylinder block 2, the rear side cylinder block 3, the valve plate 6 and the rear head 7 are fastened in the axial direction by fastening bolts 8 to configure housing of the compressor.

In the housing, the front side cylinder block 2 and rear side cylinder block 3 are assembled to define a crank chamber 10 therebetween and an oil storage chamber 11 which is leading to the crank chamber.

In the crank chamber 10, a shaft 16 is rotatably supported by radial bearings 14, 15 which are managed in shaft supporting holes 12, 13 formed in the front side cylinder block 2 and the rear side cylinder block 3, and one end of the shaft protrudes from the front head 5. Further, a shaft seal chamber 17 is disposed between an axial end of the shaft 16 and the front head 5, and a shaft seal member 18 is provided in the shaft seal chamber 17. The shaft seal material 18 is configured so as to prevent refrigerant from leaking from gap of the shaft 16 and the front head 5 to the outside of the compressor.

In addition, an electromagnetic clutch (not shown) is provided on the end of the shaft 16 which is protruded from the front head 5, and the motive power from an engine (not shown) is supplied to the shaft through the electromagnetic clutch.

Figure 3:
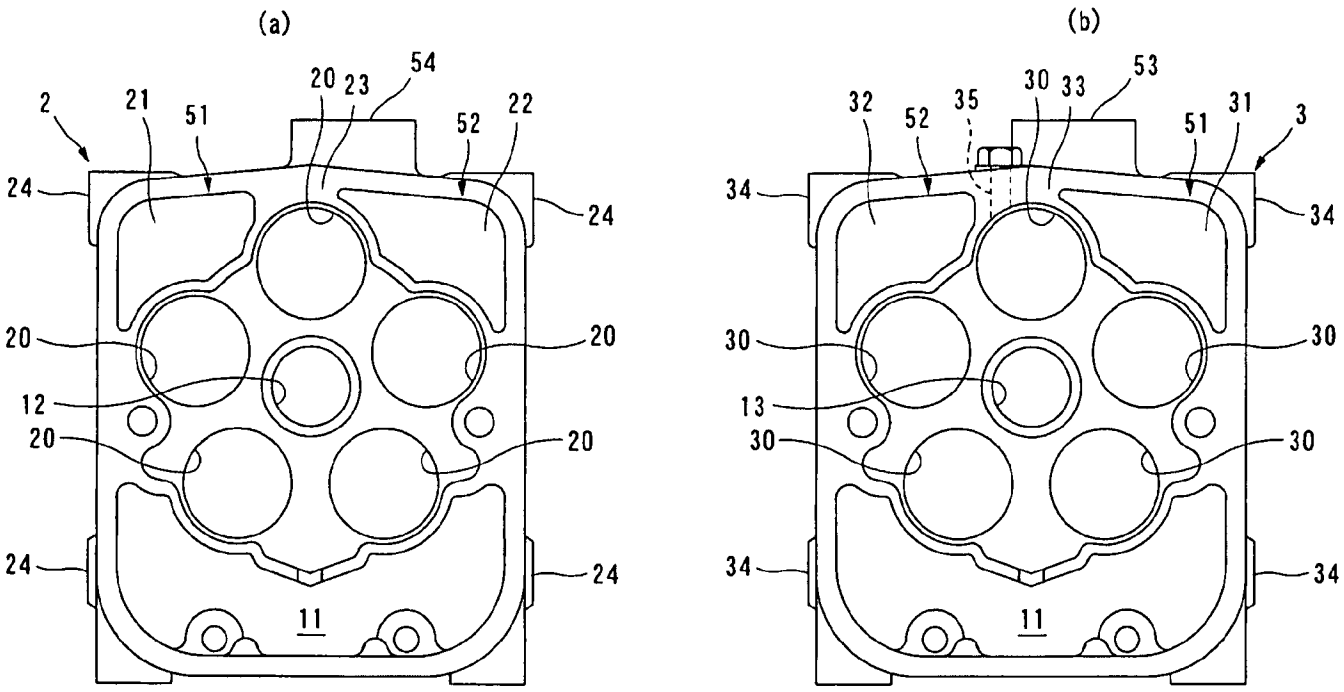
FIG. 3 is a view showing a cylinder block of a reciprocating type compressor according to the present invention, (a) is a view of a front side cylinder block seen from a connected plane (a view seen from α-α line in FIG. 1), and (b) is a view of a rear side cylinder block seen from a connected plane (a view seen from β-β line in FIG. 1).

A plurality of cylinder bores 20, 30 which are, in parallel with the shaft supporting holes 12, 13 and along the respective circumferences of virtual circles in regular intervals, centers of the virtual circles being the shaft supporting holes 12, 13 as shown in FIG. 3, are formed in the respective front side cylinder block 2 and the rear side cylinder block 3. When the front side cylinder block 20 and the rear side cylinder block 30 are assembled, the cylinder bore 20 formed in the front side cylinder block 2 and the rear side cylinder bore 30 formed in the rear side cylinder block 3 are placed in a manner that respective center lines of the cylinder bore 20 and the cylinder bore 30, both being faced each other, connects in line.

In addition, double-headed pistons 40 having heads at their both ends are inserted in the respective cylinder bores 20, 30 of the respective cylinder blocks 2, 3 and move slidably in the cylinder bores 20 back and forth in a reciprocating manner, and compression chambers 41, 42 are defined between the double-headed piston 40 and the valve plates 4, 6.

The swash plate 43 which is integrally formed with the shaft 16 is enclosed in the crank chamber 10, so that when the shaft 16 rotates, the swash plate 43 rotates. The swash plate 43 is rotatably supported by the front side cylinder block 2 and the rear side cylinder block 3 via the thrust bearings 44, 45 and its peripheral portion is associated with holding recess 48 formed at the center of the double-headed piston 40 by a pair of approximately hemispherical shaped shoes 46, 47 provided so as to sandwich the front and rear of the peripheral portion.

Accordingly, when the shaft 16 as well as the swash plate 43 rotates, the rotary movement of the swash plate 43 is converted into the reciprocating movement of the double-headed piston 40 through the shoes 46, 47 to change the capacity of the compression chambers 41, 42.

On the respective valve plates 4, 6, the suction holes 4*a*, 6*a* which are opened and closed by the respective suction valves and the discharge holes 4*b*, 6*b* which are opened and closed by the respective discharge valves are formed, correspondingly to the respective cylinder bores 20, 30. On the front head 5 and the rear head 7, suction chambers 5*a*, 7*a* for enclosing refrigerant to be supplied to the compression chambers 41, 42 and discharge chambers 5*b*,7*b* for enclosing the high-pressure refrigerant discharged from the compression chambers 41, 42 are formed, respectively. In this example, the suction chambers 5*a*, 7*a* are formed approximately on the center of the front head 5 and the rear head 7, respectively, and the discharge chambers 5*b*, 7*b* are formed around the suction chambers 5*a*, 7*a*.

Figure 4:
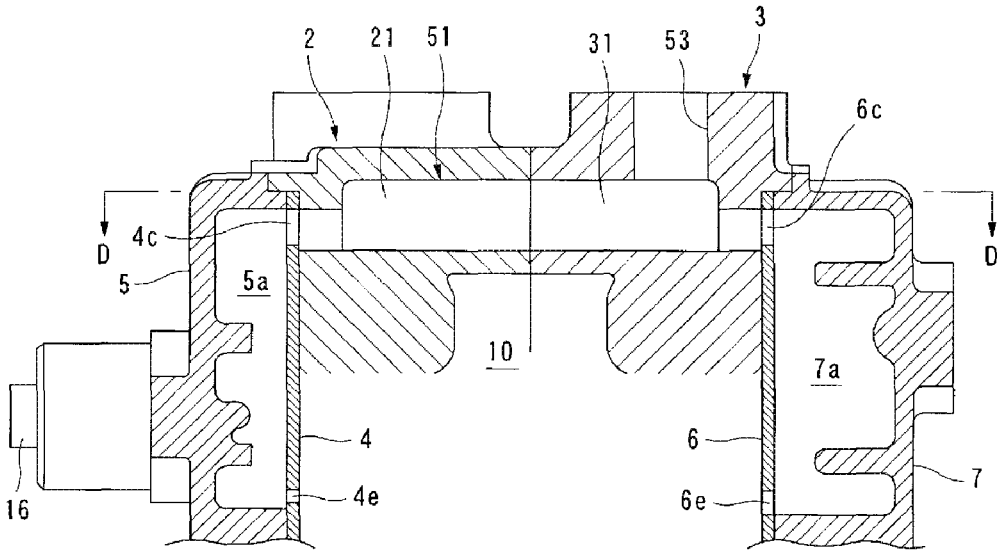
FIG. 4(*a*) is a sectional view along B-B line in FIG. 2(*a*) showing an suction side gas passage, and FIG. 4(*b*) is a sectional view along C-C line in FIG. 2(*a*) showing a discharge side gas passage.
Figure 4:
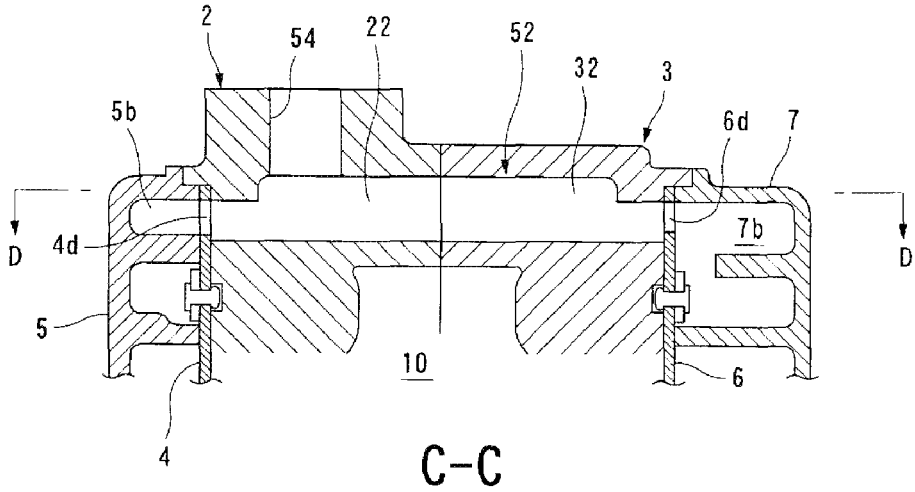

Further, at the upper portions of the front side cylinder block 2 and the rear side cylinder block 3, a gas passage on the suction side 51 and a gas passage on the discharge side 52 are provided along the axial direction of the shaft 16 so as to extend through the both cylinder blocks as shown in FIG. 4. The gas passage on the suction side 51 and the gas passage on the discharge side 52 are formed to deviate circumferentially and formed in approximately parallel from each other. The gas passage on the suction side 51 is leading to the suction chambers 5*a*, 7*a* formed in the front head 5 and the rear head 7 through open holes 4*c*, 6*c* formed in the valve plates 4, 6 and comprises a space for forming a gas passage on the suction side 21 extended in the front side cylinder block 2 in the axial direction and a space for forming a gas passage on the suction side 31 extended in the rear side cylinder block 3 in the axial direction. The gas passage on the discharge side 52 is leading to the discharge chambers 5*b*, 7*b* formed in the front head 5 and the rear head 7 through open holes 4*d*, 6*d* formed in the valve plates 4, 6 and comprises a space for forming a gas passage on the discharge side 22 extended in the front side cylinder block 2 in the axial direction and a space for forming a gas passage on the discharge side 32 extended in the rear side cylinder block 3 in the axial direction.

Further in this example, a gas port on the suction side 53 for sucking refrigerant from the external cycle is formed on the upper part (upper surface) of the rear side cylinder block 3 and a gas port on the discharge side 54 for discharging compressed refrigerant to the external cycle is formed on the upper part (upper surface) of the front side cylinder block 2. The gas port on the suction side 53 is provided right above the gas passage on the suction side 51 and formed so as to run through the side wall of the rear side cylinder block 3 defining the space for forming a gas passage on the suction side 31 on the rear side and the gas port on the discharge side 54 is provided right above the gas passage on the discharge side 52 and formed so as to run through the side wall of the front side cylinder block 2 defining the space for forming a gas passage on the discharge side 22 on the front side.

The refrigerant sucked from the gas port 53 on the suction side formed in the rear side cylinder block 3 is sent to the suction chambers 5*a*, 7*a* of the front head 5 and the rear head 7 through the open holes 4*c*, 6*c* of the valve plates 4, 6, passing through the gas passage on the suction side 51, and enters into the compression chambers 41, 42 through the suction holes 4*a*, 6*a* of the valve plates 4, 6 from the suction chambers 5*a*, 7*a*, and then compressed by reciprocation of the piston 40 and thereafter reached to the discharge chambers 5*b*,7*b* through the discharge holes 4*b*, 6*b* of the valve plates 4, 6, and discharged from the gas port on the discharge side 54 formed in the front side cylinder block 2, passing through the gas passage on the discharge side 52 through the open holes 4*d*, 6*d* of the valve plates 4, 6. In addition, a relieving passage (not shown) for relieving the internal pressure to the suction chamber to stabilize pressure in the crank chamber is formed in the cylinder block defining the crank chamber 10. The relieving passage is communicated with the suction chambers through relieving holes 4*e*, 6*e* formed in the valve plates 4, 6.

Figure 5:
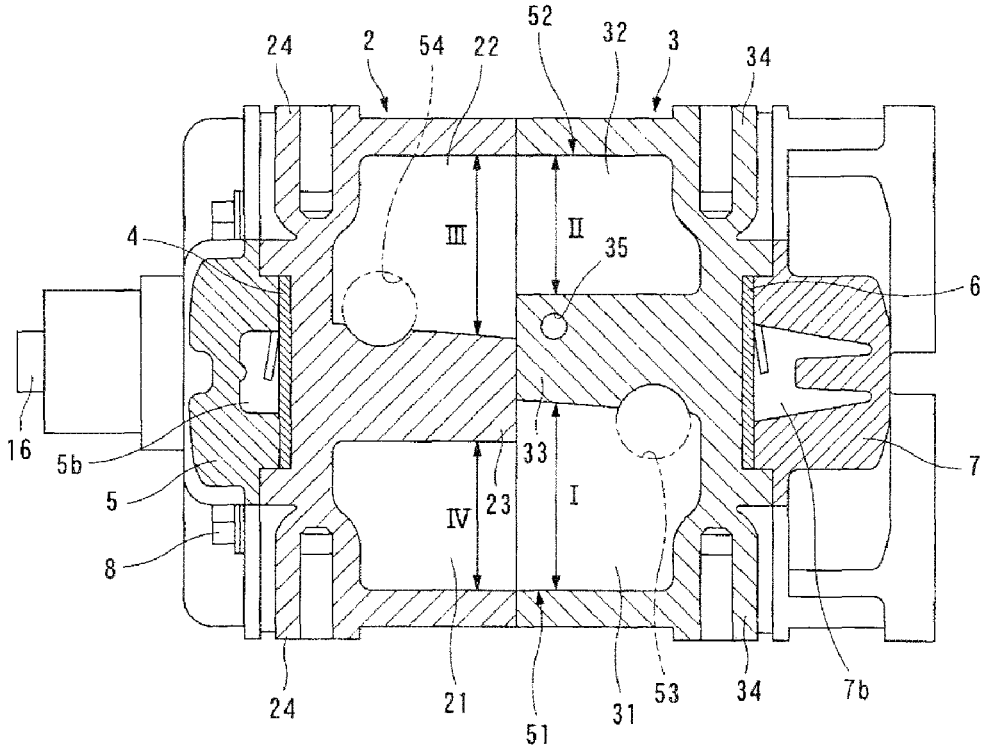
FIG. 5 is a sectional view along D-D line in FIG. 2(*b*) showing a view of the suction side gas passage and the discharge side gas passage seen from the above.

In the above-described configuration, as shown in FIG. 5, the gas passage on the suction side 51 and the gas passage on the discharge side 52 are placed in the respective front side cylinder block 2 and the rear side cylinder block 3 so that partitions walls 23, 33 which partition the spaces for forming gas passages on the suction side 21, 31 and the spaces for forming gas passages on the discharge side 22, 32 are arranged so as not to coincide completely in the circumferential direction.

As a result, the circumferential width of the spaces for forming gas passages communicating with the gas ports side (the gas port on the suction side 53 and the gas port on the discharge side 54) is formed larger than the circumferential width of the spaces forming gas passages on the side of not communicating with the gas ports 53, 54 and is asymmetrical to a vertical plane passing through an axis of the shaft.

Specially, circumferential side surfaces of the gas passage on the suction side 51 and the gas passage on the discharge side 52 (side surfaces being circumferentially farthest from the partition wall) are not deviated in the circumferential direction (formed at the same position in the circumferential direction) between the front side cylinder block 2 and the rear side cylinder block 3. On the other hand, side surfaces forming the partition walls 23, 33 of the spaces 22, 31 for forming gas passages communicated with the gas ports are positioned closer to the center line of the upper surface of the compressor than sides forming the partition walls of the spaces 21, 32 for forming gas passages not communicated with the gas ports in the respective cylinder blocks.

For this reason, in the rear side cylinder block 3, a circumferential width of the space for forming a gas passage on the suction side 31 communicated with gas port on the suction side 53 is formed larger than a circumferential width of the space for forming a gas passage on the discharge side 32 not communicated with the gas port on the suction side 53. And in the front side cylinder block 2 a circumferential width of the space 22 for forming a gas passage on the discharge side communicated with the gas port on the discharge side 54 is formed larger than a circumferential width of the space 21 for forming a gas passage on the suction side not communicated with the gas port on the discharge side 54. In other words, assuming that a circumferential width of the space for forming a gas passage on the suction side 31 communicated with the gas port on the suction side 53 in the rear side cylinder block 3 is I, a circumferential width of the space for forming a gas passage on the discharge side 32 not communicated with the gas port on the suction side 53 is II, a circumferential width of the space 22 for forming a gas passage on the discharge side communicated with the gas port on the discharge side 54 in the front side cylinder block 2 is III, and a circumferential width of the space 21 for forming a gas passage on the suction side not communicated with the gas port on the discharge side 54 in the front side cylinder block 2 is IV, they are formed so as to satisfy I>II, III>IV).

In addition, in this example, the space for forming a gas passage on the suction side 31 communicated with the gas port on the suction side 53 of the rear side cylinder block 3 and the space for forming a gas passage on the discharge side 22 communicated with the gas port on the discharge side 54 of the front side cylinder block 2 are made to have the same shape when seen from the contacted end face, and a circumferential width I of the space for forming a gas passage on the suction side 31 and the circumferential width III of the space for forming a gas passage on the discharge side 22 are formed to be equal.

Further the space 32 for forming a gas passage on the discharge side not communicated with the gas port on the suction side 53 of the rear side cylinder block 3 and the space 21 for forming a gas passage on the suction side not communicated with the gas port on the discharge side 54 of the front side cylinder block 2 are made to have the same shape when seen from the contacted end face, and a circumferential width II of the space 32 for forming a gas passage on the discharge side and the circumferential width IV of the space 21 for forming a gas passage on the suction side are formed to be equal.

Figure 6:
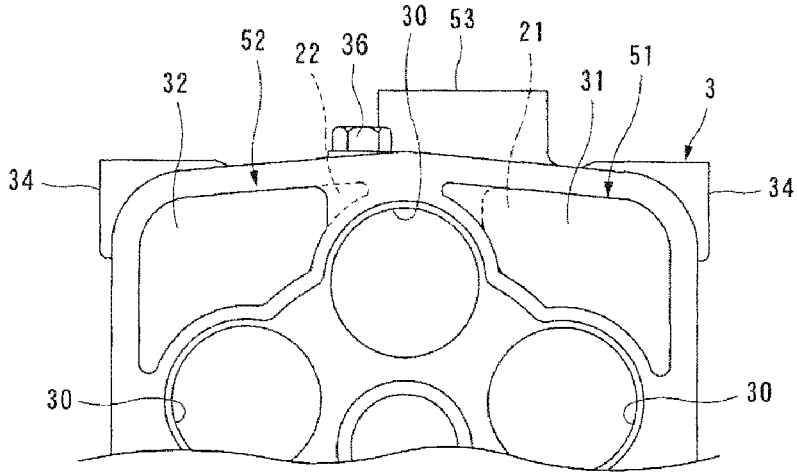
FIG. 6 is a drawing explaining a state where a space for forming a gas passage on the suction side and a space for forming a gas passage on the discharge side formed in the front side cylinder block are superimposed on the same spaces formed in the rear side cylinder block.
Figure 7:
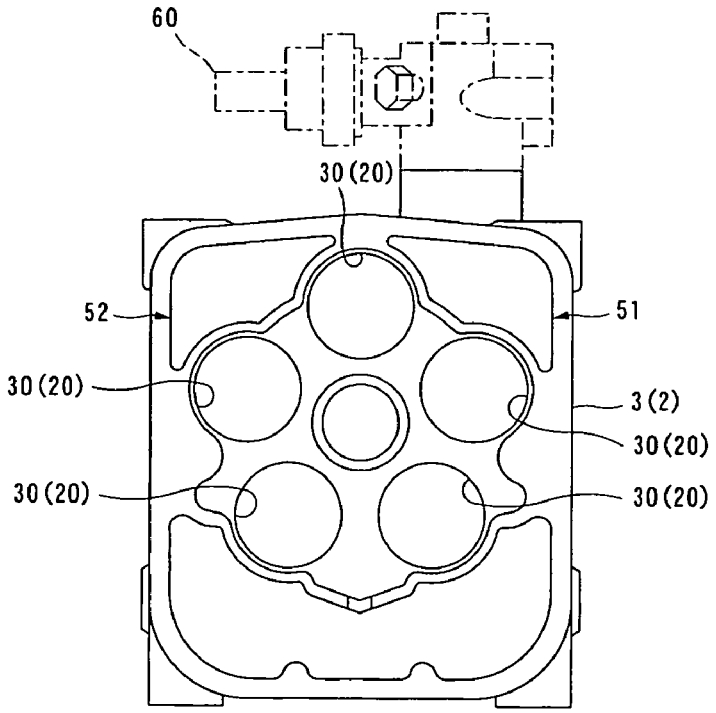
FIG. 7(*a*) is a drawing showing a cylinder block composing the conventional reciprocating type compressor, and a view of the rear side cylinder block seen from a connected plane (a view seen from γ-γ line in FIG. 8), and FIG. 7(*b*) is a plane view showing a pipe connector attached to a gas port of the cylinder block.
Figure 7:
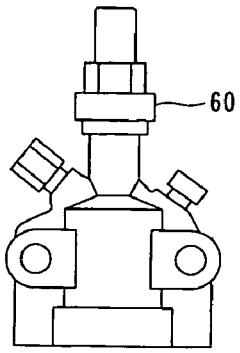
Figure 8:
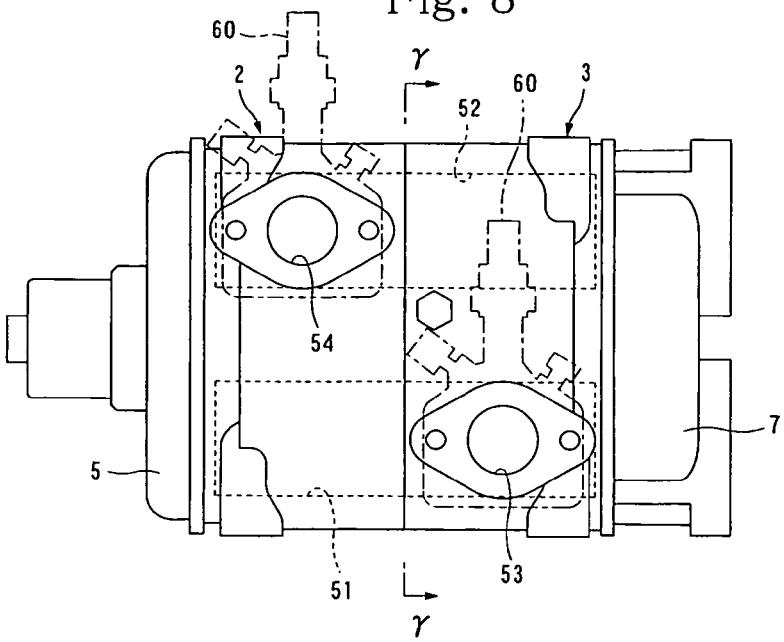
FIG. 8 is a plane view of the conventional reciprocating type compressor provided by deviating the suction side gas port and the discharge side gas port in a circumferential direction.
Figure 9:
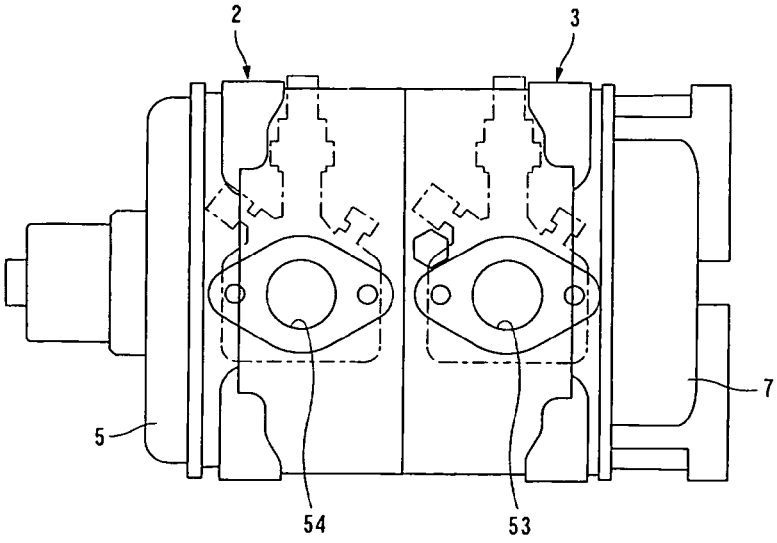
PRIOR ART Fig. 9
FIG. 9 is a plane view showing the reciprocating type compressor in which the suction side gas port and the discharge side gas port of the reciprocating type compressor illustrated in FIG. 8 are provided in parallel in the axial direction.

Additionally, the respective partition walls 23, 33 which partition the space for forming a gas passage communicated with the gas port (the gas port on the suction side 53, the gas port on the discharge side 54) and the space for forming a gas passage not communicated with the gas port are not symmetrical to the connected plane when the front side cylinder block 2 and the rear side cylinder block 3 are assembled as shown in FIG. 6, but are configured so as to contact in the axial direction of the compressor so that sealing between the space for forming a gas passage on the suction side and the space for forming a gas passage on the discharge side can be secured.

In addition, an oil introduction port 35 for introducing oil into the compressor is pierced into at least either of the front side cylinder block 2 and the rear side cylinder block 3 (the partition wall 33 of the rear side cylinder block in this example). The oil introduction port 35 is plugged by an oil plug 36.

Even if a circumferential width of the space for forming a gas passage not communicating with the gas port were configured so as to be as wide as the space for forming a gas passage communicating with the gas port (II→I, IV→III), the front side cylinder block 2 and the rear side cylinder block 3 could be assembled so that the respective partition walls contact each other in the axial direction with securing the sealing surface, but the width of the partition wall in itself would become narrower, which makes it impossible to configure the oil introduction port 35 without interfering with the space for forming a gas passage or the gas port. For this reason, in the present example, only the circumferential width of the space for forming a gas passage communicating with the gas port is made larger, and thus the partition walls 23, 33 secures enough width for enabling to pierce the oil introduction port 35 without interfering with the space for forming a gas passage or the gas port.

On the other hand, the respective cylinder bores 20, 30, the crank chamber 10 and the oil storage chamber 11 of the front side cylinder block 2 and the rear side cylinder block 3 are formed to be symmetrical to the connected plane when the front side cylinder block 2 and the rear side cylinder block 3 are assembled, and further formed symmetrical to a vertical plane containing an axis of the shaft 16. Further, on the circumferential surface of the respective cylinder blocks 2, 3, a pair of mounting legs 24, 34 protruding toward transverse direction are formed, and the mounting legs 24 formed on the front side cylinder block 2 and the mounting legs 34 formed on the rear side cylinder block 3 are formed to be symmetrical to the connected plane between the front side cylinder block 2 and the rear side cylinder block 3, and further formed symmetrical to a vertical plane containing an axis of the shaft 16.

In addition, with respect to the front side cylinder block 2 and the rear side cylinder block 3 described above, the circumferential width of the spaces 22, 31 for forming gas passages communicating with the gas ports is made larger than the circumferential width of the spaces 21, 32 for forming gas passages not communicating with the gas ports, but since shapes seen from the respective assembled surfaces are formed so as to have the same shape excluding the oil introduction port 35 as shown in FIG. 3 (as described above, the spaces 22, 31 for forming gas passages communicating with the gas ports are arranged so as to have the same shape, the spaces 21, 32 for forming gas passages not communicating with the gas ports are formed to have the same shape, and position of the gas ports is formed at the same position when seen from the assembled surface), therefore, the front side cylinder block 2 and the rear side cylinder block 3 are manufactured using the same forming die. As to the rear side cylinder block 3, the oil introduction port 35 is pierced in the partition wall 33 afterwards.

Therefore, according to the above-described configuration, the gas port on the suction side 53 and the gas port on the discharge side 54 can be arranged closer to the center as much as possible, which enables to decrease the protrusion length of the pipe connector 60 having a shut off valve to be connected with each of the gas ports in the lateral direction (in the tangential direction) of the cylinder block. Further, the circumferential width of the space for forming gas passage not communicating with the gas port is made smaller than the circumferential width of the space for forming gas passage communicating with the gas port, which enables to have enough width of the partition walls 23, 33, which makes possible to pierce the oil introduction port 35 without interfering with the space for forming a gas passage and the gas port.

Further, the cylinder bores 20, 30, the crank chamber 10, and further in this example, the oil storage chamber 11, the mounting legs 24, 34 are formed symmetrical to a connected plane between the front side cylinder block 2 and the rear side cylinder block 3, and formed symmetrical to a vertical plane containing an axis of the shaft 16, which enables to make rigidity of the front side cylinder block 2 and the rear side cylinder block 3 substantially the same, reducing the partial wear of a slidable portion of the thrust bearings 44, 45 and the cylinder blocks (the front side cylinder block 2 and the rear side cylinder block 3) which receives the thrust load.

Further, the front side cylinder block 2 and the rear side cylinder block 3 are manufactured using the same forming die, and the oil introduction port 35 can be pierced into the partition wall 33 of the cylinder block used as the rear side cylinder block 3 afterwards, which eliminates the burden of producing the respective cylinder blocks using the different forming die, which enables to reduce time consuming production process and production costs.

The above-described example shows a configuration in which the oil introduction port 35 is formed on the partition wall 33 of the rear side cylinder block 3, but the oil introduction port can be disposed on the partition wall 23 of the front side cylinder block 2 instead of this configuration or together with this configuration.

LIST OF REFERENCE NUMBERS

1 reciprocating-type compressor (compressor)
2 front side cylinder block
3 rear side cylinder block
10 crank chamber
16 shaft
20 front side cylinder bore
21, 31 space for forming gas passage on the suction side
22, 32 space for forming gas passage on the discharge side
23, 33 partition wall
24, 34 mounting leg
30 rear side cylinder bore
35 oil introduction port
40 piston
51 gas passage on the suction side
52 gas passage on the discharge side
53 gas port on the suction side
54 gas port on the discharge side
60 pipe connector

The invention claimed is:

1. A reciprocating-type compressor comprising:

a front side cylinder block on which front side cylinder bores are formed, a rear side cylinder block on which rear side cylinder bores are formed, a crank chamber which is formed between the front side cylinder block and the rear side cylinder block by assembling them, a shaft which goes through the crank chamber and is rotatably supported in the front side cylinder block and the rear side cylinder block, a swash plate which is provided in the crank chamber and is rotated by the shaft, double-headed pistons which are each inserted in respective cylinder bores of the front side cylinder block and the rear side cylinder block which face each other and are reciprocated by rotation of the swash plate, a space for forming a gas passage on a suction side and a space for forming a gas passage on a discharge side extending along an axial direction of the shaft and being provided in parallel outside a pitch circle of the cylinder bores in the front side cylinder block and the rear side cylinder block respectively, a gas passage on the suction side formed by connecting the space for forming the gas passage on the suction side formed in the front side cylinder block and the space for forming the gas passage on the suction side formed in the rear side cylinder block, a gas passage on the discharge side formed by connecting the space for forming the gas passage on the discharge side formed in the front side cylinder block and the space for forming the gas passage on the discharge side formed in the rear side cylinder block, a gas port on the suction side leading to the space for forming the gas passage on the suction side and being provided in one of the front side cylinder block and the rear side cylinder block, a gas port on the discharge side leading to the space for forming the gas passage on the discharge side and being provided in the other of the front side cylinder block and the rear side cylinder block, and a partition wall which partitions the space for forming the gas passage on the suction side and the space for forming the gas passage on the discharge side and is placed such that a circumferential width of the space for forming the gas passage communicated with the gas port is larger than a circumferential width of the space for forming the gas passage not communicated with the gas port in each of the front side cylinder block and the rear side cylinder block, wherein the respective partition walls are contacted with each other in the axial direction when the front side cylinder block and the rear side cylinder block are assembled.

2. The reciprocating-type compressor according to claim 1, wherein the front side cylinder bores, the rear side cylinder bores and the crank chamber are arranged symmetrical respectively to a connected plane on which the front side cylinder block and the rear side cylinder block are connected, and also are arranged symmetrical respectively to a vertical plane containing an axis of the shaft.

3. The reciprocating-type compressor according to claim 2, wherein the respective gas port on the suction side and the gas port on the discharge side are arranged closer to the partition wall, than to a side surface being circumferentially farthest from the partition wall.

4. The reciprocating-type compressor according to claim 3, wherein an oil introduction port leading to the crank chamber is provided at the partition wall in at least one of the front side cylinder block and the rear side cylinder block.

5. The reciprocating-type compressor according to claim 4, wherein each of the gas port on the suction side and the gas port on the discharge side has a pipe connector with a shut-off valve which is arranged perpendicular to a longitudinal axis of the compressor, and extending in a tangential direction from a periphery of the cylinder block.

6. The reciprocating-type compressor according to claim 5, wherein the front side cylinder block and the rear side cylinder block have mounting legs for fixing the front side cylinder block and the rear side cylinder block at mounting portions, wherein the mounting legs are formed symmetrical to the connected plane on which the front side cylinder block and the rear side cylinder block are connected, and also are arranged symmetrical to the vertical plane containing the axis of the shaft.

7. The reciprocating-type compressor according to claim 2, wherein an oil introduction port leading to the crank chamber is provided at the partition wall in at least one of the front side cylinder block and the rear side cylinder block.

8. The reciprocating-type compressor according to claim 2, wherein each of the gas port on the suction side and the gas port on the discharge side has a pipe connector with a shut-off valve which is arranged perpendicular to a longitudinal axis of the compressor, and extending in a tangential direction from a periphery of the cylinder block.

9. The reciprocating-type compressor according to claim 2, wherein the front side cylinder block and the rear side cylinder block have mounting legs for fixing the front side cylinder block and the rear side cylinder block at mounting portions, wherein the mounting legs are formed symmetrical to the connected plane on which the front side cylinder block and the rear side cylinder block are connected, and also are arranged symmetrical to the vertical plane containing the axis of the shaft.

10. The reciprocating-type compressor according to claim 1, wherein the respective gas port on the suction side and the gas port on the discharge side are arranged closer to the partition wall, than to a side surface being circumferentially farthest from the partition wall.

11. The reciprocating-type compressor according to claim 10, wherein an oil introduction port leading to the crank chamber is provided at the partition wall in at least one of the front side cylinder block and the rear side cylinder block.

12. The reciprocating-type compressor according to claim 11, wherein each of the gas port on the suction side and the gas port on the discharge side has a pipe connector with a shut-off valve which is arranged perpendicular to a longitudinal axis of the compressor, and extending in a tangential direction from a periphery of the cylinder block.

13. The reciprocating-type compressor according to claim 10, wherein each of the gas port on the suction side and the gas port on the discharge side has a pipe connector with a shut-off valve which is arranged perpendicular to a longitudinal axis of the compressor, and extending in a tangential direction from a periphery of the cylinder block.

14. The reciprocating-type compressor according to claim 1, wherein an oil introduction port leading to the crank chamber is provided at the partition wall in at least one of the front side cylinder block and the rear side cylinder block.

15. The reciprocating-type compressor according to claim 1, wherein each of the gas port on the suction side and the gas port on the discharge side has a pipe connector with a shut-off valve which is arranged perpendicular to a longitudinal axis of the compressor, and extending in a tangential direction from a periphery of the cylinder block.

16. The reciprocating-type compressor according to claim 1, wherein the front side cylinder block and the rear side cylinder block have mounting legs for fixing the front side cylinder block and the rear side cylinder block at mounting portions, wherein the mounting legs are formed symmetrical to a connected plane on which the front side cylinder block and the rear side cylinder block are connected, and also are arranged symmetrical to a vertical plane containing an axis of the shaft.

* * * * *